United States Patent [19]

Kimura et al.

[11] 4,379,999

[45] Apr. 12, 1983

[54] ELECTROSTATIC SHIELD FOR A TRANSFORMER

[75] Inventors: Minoru Kimura, Nishinomiya; Teruo Ina, Takarazuka, both of Japan

[73] Assignee: Mitsubishi Denki Kabushiki Kaisha, Tokyo, Japan

[21] Appl. No.: 316,905

[22] Filed: Oct. 30, 1981

[30] Foreign Application Priority Data

Nov. 5, 1980 [JP] Japan ..... 55/158679[U]

[51] Int. Cl.[3] ..... H01F 15/04

[52] U.S. Cl. ..... 336/84 C; 174/35 CE

[58] Field of Search ..... 336/84 R, 84 C, 69, 336/70; 310/256; 174/35 CE, 35 GC, 35 MS

[56] References Cited

U.S. PATENT DOCUMENTS 3,602,858 8/1971 Moone et al. ..... 336/84 C X 4,153,891 5/1979 McNutt ..... 336/84 C X

OTHER PUBLICATIONS

Report by Mitsubishi Denki Corporation entitled "Applications and Circumstances of Gas-Insulated Transformers," vol. 54, No. 8, 1980 and an English translation thereof.

*Primary Examiner*—Thomas J. Kozma

*Attorney, Agent, or Firm*—Wenderoth, Lind & Ponack

[57] ABSTRACT

An electrostatic shield for an electrical transformer comprises a substantially ring-shaped inner insulator of asymmetric vertical cross-section with a side confronting a coil of the transformer being substantially planar and the remaining surface being of a curved section, a field concentration relaxation conductor formed from a conductive foil, completely surrounding the inner insulator, and a multiple outer insulator comprising at least one layer of polyethylene terephthalate (PET) film and at least one mica insulation layer with mica bonded to a non-conductive backing film such as glass tape or PET film by a bonding agent such as epoxy resin, whereby the dielectric strength of the electrostatic shield and hence the transformer, is substantially improved.

6 Claims, 6 Drawing Figures

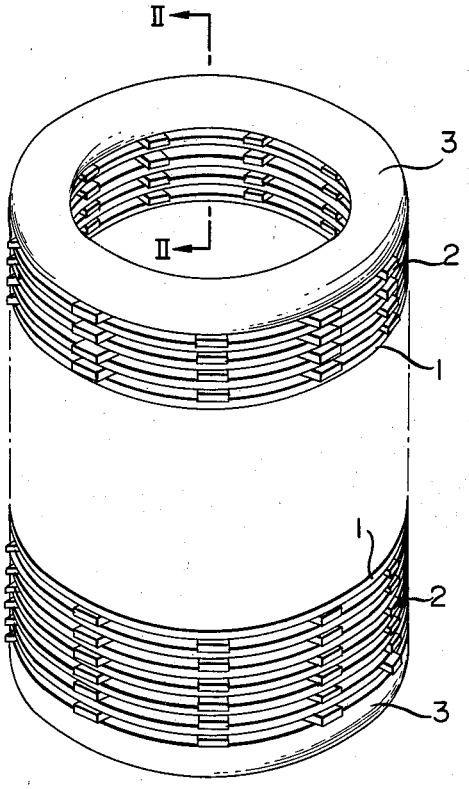
FIG. 1
FIG. 2
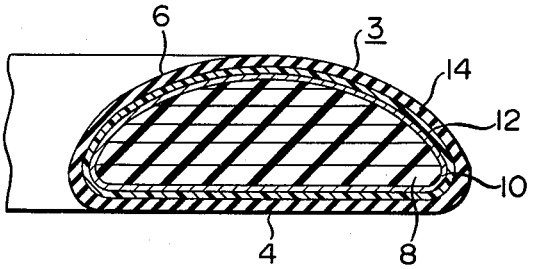
FIG. 6
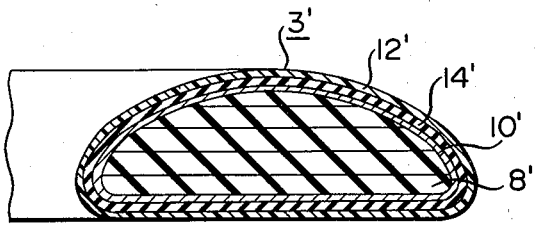

FIG. 3
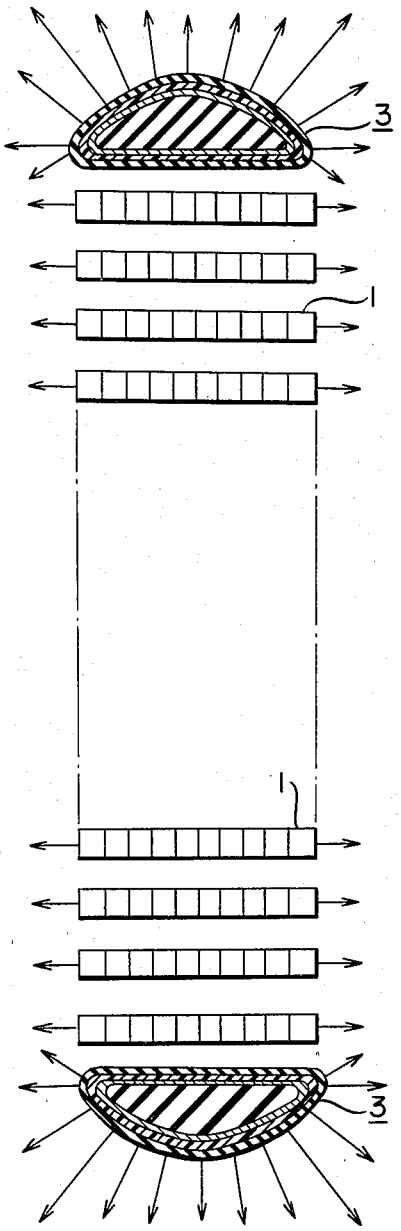
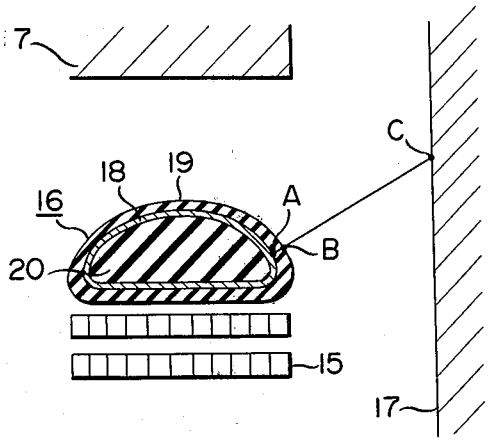
FIG. 4
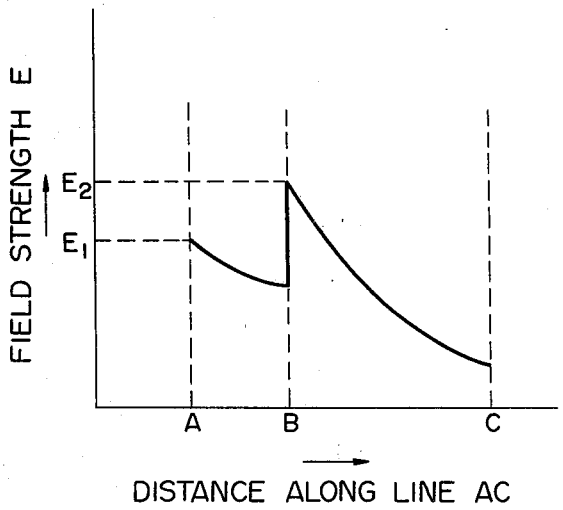
FIG. 5

ELECTROSTATIC SHIELD FOR A TRANSFORMER

BACKGROUND OF THE INVENTION

1. Field of the Invention

This invention relates to electrostatic shields for electrical transformers, and in particular relates to an improvement in the dielectric strength thereof.

2. Description of the Prior Art

Typically, electrical transformers used in air or in an insulating gas comprise a cylindrically wound coil with insulating spacers disposed between the windings thereof, and an electrostatic shield disposed at each of the two ends of the coil. Heretofore these electrostatic shields were formed in a roughly "doughnut" shaped ring with an asymmetric cross-section, with one flat and one curved side. In cross-section, this "doughnut" ring comprised an inner insulator, around which was wound a field concentration relaxation conductor formed from a conductive foil, and wound around this relaxation conductor was a polyethylene terephthalate film (hereinbelow referred to as PET film), which formed an outer insulator.

When a voltage was applied to a transformer thus constructed, a field of differing local strengths and directions was produced, with a field of great strength produced in the electrostatic shields. The construction of the electrostatic shields involved the problem, however, that their dielectric for a transformer strength was not very high, and dielectric breakdowns occurred between the field concentration relaxation conductor and ground through the PET film, particularly at certain points where field strength was greatest.

In order to increase the dielectric strength of the electrostatic shields, both increasing the number of windings of the PET film, to increase the thickness of the outer layer, and providing the electrostatic shields with a greater degree of curvature have been considered, but neither method is able to achieve more than a small increase in dielectric breakdown voltage, and these methods also involved increased physical dimensions of the electrostatic shields, and significantly increased costs.

SUMMARY OF THE INVENTION

It is an object of the present invention to do away with the aforementioned drawbacks of the prior art by providing an electrostatic shield for an electrical transformer comprising a substantially ring-shaped inner insulator of asymmetic vertical cross-section with a side confronting a coil of the transformer being substantially planar and the remaining surface being of a curved section, a field concentration relaxation conductor formed from a conductive foil, completely surrounding the inner insulator, and a multiple outer insulator comprising at least one layer of polyethylene terephthalate (PET) film and at least one mica insulation layer with mica bonded to a non-conductive backing film such as glass tape or PET film by a bonding agent such as epoxy resin, whereby the dielectric strength of the electrostatic shield and hence the transformer, is substantially improved.

BRIEF DESCRIPTION OF THE DRAWINGS

Other objects and advantages of this invention will become apparent from the following description taken in conjunction with the accompanying drawings wherein are set forth by way of illustration and example certain embodiments of this invention.

FIG. 1 is a perspective view of the coil portion of a transformer such as that in which an electrostatic shield according to the present invention is applied;

FIG. 2 is a cross-sectional view of an electrostatic shield according to an embodiment of this invention;

FIG. 3 is a diagram of a section of the coil shown in FIG. 1, shown in cross-section with arrows indicating the local direction and strength of a field produced in the transformer;

FIG. 4 is a diagram showing a portion of the coil shown in FIG. 1, shown in cross-section to illustrate the mode of electrical discharges within the transformer;

FIG. 5 is a graph showing the relationship between the field strengths and their point of origin; and FIG. 6 is a cross-section view of an electrostatic shield according to another embodiment of this invention.

DESCRIPTION OF THE PREFERRED EMBODIMENTS

FIG. 1 shows a coil of a transformer such as that in which an electrostatic shield according to the present invention is typically employed, such coil being used in air or an insulating gas. As shown in FIG. 1, a cylindrically wound coil 1 is wound with insulating spacers 2 inserted between the windings, and electrostatic shields 3 are disposed at each of the two ends of the coil 1. The electrostatic shields 3 are roughly "doughnut" shaped, being formed in a substantially ring shape with an a symmetric vertical cross-section, as shown in FIG. 2, with a substantially planar surface 4 confronting the coil 1 and another side 6 of a curved section. The internal construction of an electrostatic shield according to an embodiment of the present invention is shown in FIG. 2 taken along the line II—II in FIG. 1. In FIG. 2, the innermost portion of the cross-section of the electrostatic shield, the inner insulator 8 is formed of an insulating material with a number of press boards of the insulating material stacked together. The inner insulator 8 is formed in a shape roughly that of the complete electrostatic shield, but with a smaller cross-section area. A conductive foil is wound around the outer surface of the inner insulator to form a sheet which constitutes a field concentration relaxation conductor 10. Then, wound around this relaxation conductor 10 is a multiple outer insulation layer comprising a mica insulation layer 12 comprising aggregate mica bonded to a non-conductive backing film of a material such as glass tape or polyethylene terephthalate (PET) film with a bonding agent such as an epoxy resin, the resultant composite tape being wound around the relaxation conductor to form a continuous layer, and a PET film outer insulator 14 formed by winding a PET film around the outer surface of the mica insulation layer.

To fully understand the construction and effects of the present invention it is appropriate here to explain the problem of dielectric breakdowns more fully. FIG. 3 showns a cross-sectional view of a portion of a coil 1 and associated electrostatic shields 3 as employed in the transformer shown in FIG. 1, with arrows which indicate by their direction and length the local direction and strength of the electrical field that is produced when a voltage is applied. As will be seen the local strength varies somewhat, with the strongest field occurring in the electrostatic shields 3. FIGS. 4 and 5 show the relationship between the strength of the field and its location. FIG. 4 shows a portion of a transformer coil and associated electrostatic shields as used in the prior art shown for the purposes of explanation, showing just one end of the coil 15 and one electrostatic shield 16. In FIG. 4, the ground potential member 17 is illustrated in addition to those portions of the transformer illustrated in FIG. 3. It is between the boundary (point A) between the field concentration relaxation conductor 18 and the next layer, the outer insulator 19, and ground 17 (point C), or the boundary (point B) between the outer surface of the electrostatic shield, the outer insulator 19, and ground 17 (point C) that discharging, i.e. dielectric breakdown, occurs, the line AC representing the field at the point shown. FIG. 5 is a graph showing the relationship between the field strength on the line AC and the place of origin of the field. From FIG. 5 it will be understood that strong fields $E_1$ and $E_2$ are produced at points A and B respectively. The magnitude of $E_1$ and $E_2$ is determined by the magnitude of the applied voltage and the ratio of the distances AB and BC. Point A or point B is therefore the point of maximum field from which the first discharge is produced. And once discharging has commenced dielectric breakdown between the conductor member and the ground member occurs, regardless of the thickness of the outer insulation or the distance in gas or air-filled space.

It is accordingly necessary to increase the degree of effective insulation surrounding the relaxation conductor, and it is to this end that the present inventors have conducted their research resulting in the present invention.

From this research it was concluded that a material of higher dielectric strength than PET film should be employed at the region of greatest field strength, either at the boundary between the field concentration relaxation conductor and the outer insulator (i.e. A on the line AC), or at the boundary between the outer insulator and the surrounding air or gas (i.e. B on the line AC). This, it was concluded would retain the cost effectiveness of using PET as an outer insulator while increasing the dielectric strength at points closest to the parts of greatest field strength A or B. As the material for this extra insulation layer, mica was selected, as this provides a per-thickness dielectric strength at least 50% higher than PET film, and this mica, as described in relation to the above embodiment is bonded in aggregate form to a backing film of glass tape or PET film with a bonding agent such as epoxy resin. The mica film thus surrounds or is surrounded by a PET film such as is used in the prior art, to provide the electrostatic shield with a multiple outer insulator which provides specifically improved dielectric strength, or a substantial increase in the discharge start voltage, and hence a substantial improvement in the dielectric strength of the transformer.

FIG. 6 shows in section an electrostatic shield according to another embodiment of the present invention, wherein the relative positions of the PET film outer insulator 14' and the mica insulation layer 12' are reversed in relation to the former embodiment such the electrostatic shield 3' according to this second embodiment comprises an inner insulator 8' surrounded by a field concentration relaxation conductor 10' which is surrounded by a PET film outer insulator 14', which is in turn surrounded by an outermost layer comprising a mica insulation layer 12' formed in the same manner as that of the former embodiment. This disposition of the mica insulation 12' at the boundary between the PET film and the gas or air surrounding the coil is particularly effective in instances of discharge starts ($E_2$ in FIG. 5) originating at this boundary.

Thus according to this invention, by means of a construction wherein a multiple outer insulation layer is provided around the field concentration relaxation conductor, the multiple oute insulation layer comprising a mica insulation layer and a PET film layer, the dielectric strength of an electrostatic shield for a transformer coil can be improved. That is to say, it is possible to suppress discharging starting from the point A or B (in FIG. 4) of maximum field strength, by means of a mica insulation layer of high dielectric strength, whereby the dielectric strength of the transformer coil is raised.

What is claimed is:

1. An electrostatic field for an electrical transformer coil comprising a substantially ring shaped inner insulator, a field concentration relaxation conductor formed by winding a conductive foil into a sheet forming a layer completely surrounding the inner insulator, and a multiple outer insulation layer surrounding the field concentration relaxation conductor, said multiple outer insulation layer comprising at least one layer of polyethylene terephthalate film and at least one mica insulation layer.

2. An electrostatic shield as claimed in claim 1 wherein said multiple outer insulation layer comprises a mica insulation layer which surrounds said field concentration relaxation conductor and a polyethylene terephthalate film layer which surrounds said mica insulation layer.

3. An electrostatic shield as claimed in claim 1 wherein said multiple outer insulation layer comprises a polyethylene terephthalate film layer which surrounds said field concentration relaxation conductor, and a mica insulation layer which surrounds said polyethylene terephthalate film layer.

4. An electrostatic shield as claimed in any one of claims 1 to 3 wherein said mica insulation layer is formed by bonding aggregate mica to a non-conductive backing film with a bonding agent.

5. An electrostatic shield as claimed in claim 4 wherein said non-conductive backing film is selected from a group consisting of glass tape and polyethylene terephthalate film, and said bonding agent is epoxy resin.

6. An electrostatic shield as claimed in claim 1 wherein said inner insulator comprises press boards of an insulating material stacked together, and is formed substantially as a ring with an asymmetric vertical cross-section with one side for confronting a coil of said transformer being substantially planar and the remaining surface being of a curved section.

* * * * *